US012535069B2

(12) United States Patent
Waldhoer et al.

(10) Patent No.: US 12,535,069 B2
(45) Date of Patent: Jan. 27, 2026

(54) RECIPROCATING PUMP POWER END WITH MONOLITHIC CORE

(71) Applicant: GD Energy Products, LLC, Tulsa, OK (US)

(72) Inventors: Timo Waldhoer, Tahlequah, OK (US); Randall Turner Hall, Jr., Claremore, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 0 days.

(21) Appl. No.: 18/752,080

(22) Filed: Jun. 24, 2024

(65) Prior Publication Data

US 2025/0389269 A1 Dec. 25, 2025

(51) Int. Cl.

| | |
|---|---|
| ***F04B 53/16*** | (2006.01) |
| ***F04B 1/00*** | (2020.01) |
| ***F04B 3/00*** | (2006.01) |
| ***F04B 9/109*** | (2006.01) |
| ***F04B 9/111*** | (2006.01) |

(Continued)

(52) U.S. Cl.

CPC ..... *F04B 53/162* (2013.01); *F04B 1/005* (2013.01); *F04B 3/003* (2013.01); *F04B 9/1095* (2013.01); *F04B 9/1115* (2013.01); *F04B 27/0891* (2013.01); *F04B 27/1081* (2013.01); *F04B 39/121* (2013.01); *F04B 39/128* (2013.01)

(58) Field of Classification Search

CPC .... F04B 1/005; F04B 1/02; F04B 1/03; F04B 3/003; F04B 7/0053; F04B 7/06; F04B 9/109; F04B 9/1095; F04B 9/1115; F04B 19/22; F04B 23/06; F04B 23/10; F04B 27/0891; F04B 27/1081; F04B 39/0094; F04B 39/0276; F04B 39/12; F04B 39/121; F04B 39/122; F04B 39/125; F04B 39/127; F04B 39/128; F04B 39/14; F04B 53/162

See application file for complete search history.

(56) References Cited

U.S. PATENT DOCUMENTS

| | | | |
|---|---|---|---|
| D759,728 | S | 6/2016 | Byrne et al. |
| D791,192 | S | 7/2017 | Byrne et al. |

(Continued)

FOREIGN PATENT DOCUMENTS

| | | | |
|---|---|---|---|
| CA | 3187352 | A1 | 12/2021 |
| CN | 112360714 | A | 2/2021 |
| WO | 2021/257570 | A1 | 12/2021 |

OTHER PUBLICATIONS

LEWA, "LEWA triplex® process pumps for high-pressure processes," LEWA GmbH, Feb. 9, 2023, 4 pages.

(Continued)

*Primary Examiner* — Binh Q Tran

(74) *Attorney, Agent, or Firm* — Edell, Shapiro & Finnan, LLC

(57) ABSTRACT

A power end includes a monolithic core with a base having a surface configured to mount to a fluid end of the reciprocating pump and a plurality of extensions integral to the base. Each extension of the plurality of extensions includes a ring portion that defines an opening configured to receive a crankshaft of the reciprocating pump. The power end also includes a plurality of plates separate from the monolithic core. Each plate of the plurality of plates extends between a pair of adjacent of extensions of the plurality of extensions to enclose the monolithic core.

20 Claims, 8 Drawing Sheets

(51) Int. Cl.

| | |
|---|---|
| ***F04B 27/08*** | (2006.01) |
| ***F04B 27/10*** | (2006.01) |
| ***F04B 39/12*** | (2006.01) |

(56) References Cited

U.S. PATENT DOCUMENTS

| | | | | |
|---|---|---|---|---|
| D791,193 | S | 7/2017 | Byrne et al. | |
| 9,879,659 | B2 | 1/2018 | Kumar et al. | |
| 10,087,992 | B2 | 10/2018 | Bayyouk et al. | |
| 10,393,182 | B2 | 8/2019 | Byrne et al. | |
| D870,156 | S | 12/2019 | Byrne et al. | |
| D870,157 | S | 12/2019 | Byrne et al. | |
| 10,520,037 | B2 | 12/2019 | Kumar et al. | |
| 10,677,244 | B2 | 6/2020 | Byrne et al. | |
| 11,162,479 | B2 | 11/2021 | Thomas et al. | |
| 11,204,030 | B2 | 12/2021 | Kumar et al. | |
| 11,208,996 | B2 | 12/2021 | Foster et al. | |
| 11,300,111 | B2 | 4/2022 | Thomas et al. | |
| 11,346,339 | B2 | 5/2022 | Nowell et al. | |
| 11,359,615 | B2 | 6/2022 | Thomas et al. | |
| 11,480,170 | B2 | 10/2022 | Byrne et al. | |
| 11,560,884 | B2 | 1/2023 | Thomas et al. | |
| 11,578,711 | B2 | 2/2023 | Thomas et al. | |
| 11,635,068 | B2 | 4/2023 | Foster et al. | |
| 11,635,151 | B2 | 4/2023 | Foster et al. | |
| 11,639,654 | B2 * | 5/2023 | Yeung | F04B 53/147 166/379 |
| 11,644,018 | B2 | 5/2023 | Thomas et al. | |
| 11,686,296 | B2 | 6/2023 | Son et al. | |
| 12,092,102 | B2 * | 9/2024 | Kay | F04B 53/22 |
| 2014/0170006 | A1 * | 6/2014 | Bergman | F04B 49/22 417/559 |
| 2019/0032720 | A1 | 1/2019 | Bayyouk et al. | |
| 2019/0277341 | A1 | 9/2019 | Byrne et al. | |
| 2020/0332788 | A1 | 10/2020 | Cui et al. | |
| 2020/0386221 | A1 | 12/2020 | Pham et al. | |
| 2021/0123435 | A1 | 4/2021 | Cui et al. | |
| 2021/0270264 | A1 * | 9/2021 | Byrne | F04B 53/006 |
| 2021/0301807 | A1 | 9/2021 | Cui et al. | |
| 2021/0341079 | A1 | 11/2021 | Thomas et al. | |
| 2022/0235751 | A1 | 7/2022 | Thomas et al. | |
| 2022/0282719 | A1 * | 9/2022 | Barnhouse | F04B 53/168 |
| 2022/0282725 | A1 | 9/2022 | Nowell et al. | |
| 2022/0389916 | A1 | 12/2022 | Keith et al. | |
| 2022/0397107 | A1 | 12/2022 | Thomas et al. | |
| 2023/0003207 | A1 * | 1/2023 | Foster | F04B 15/02 |
| 2023/0012666 | A1 | 1/2023 | Keith et al. | |
| 2023/0022890 | A1 | 1/2023 | Thomas et al. | |
| 2023/0036956 | A1 * | 2/2023 | Louzon | F04B 53/006 |
| 2023/0039253 | A1 | 2/2023 | Kumar et al. | |
| 2023/0047066 | A1 | 2/2023 | Barnett et al. | |
| 2023/0050603 | A1 | 2/2023 | Foster et al. | |
| 2023/0160382 | A1 | 5/2023 | Thomas et al. | |
| 2023/0193887 | A1 | 6/2023 | Thomas et al. | |
| 2023/0213032 | A1 * | 7/2023 | Shampine | F04B 53/006 417/321 |
| 2024/0175435 | A1 | 5/2024 | Yao et al. | |

OTHER PUBLICATIONS

Notification of Transmittal of International Search Report and Written Opinion including International Search Report and Written Opinion for International Application No. PCT/US2025/034728, mailed Sep. 17, 2025, 15 pages.

* cited by examiner

RECIPROCATING PUMP POWER END WITH MONOLITHIC CORE

TECHNICAL FIELD

The present disclosure relates to the field of high pressure reciprocating pumps and, in particular, to a reciprocating pump power end with a monolithic core.

BACKGROUND

High pressure reciprocating pumps are often used to deliver high pressure fluids during earth drilling operations. Generally, a reciprocating pump includes a power end and a fluid end. The power end can generate forces sufficient to cause the fluid end to deliver high pressure fluids to earth drilling operations. For example, the power end includes a crankshaft that drives a plurality of reciprocating plungers or pistons near or within the fluid end to pump fluid at high pressure. The power end also includes components that enclose the crankshaft. During operation of the reciprocating pump, the fluid end exerts a significant amount of force onto these power end components.

SUMMARY

The present application relates to a power end of a reciprocating pump. The techniques discussed herein may be embodied as at least a power end and a power end core.

More specifically, in accordance with at least one embodiment, the present application is directed to a power end for a reciprocating pump. The power end includes a monolithic core with a base having a surface configured to mount to a fluid end of the reciprocating pump and a plurality of extensions integral to the base. Each extension of the plurality of extensions includes a ring portion that defines an opening configured to receive a crankshaft of the reciprocating pump. The power end also includes a plurality of plates separate from the monolithic core. Each plate of the plurality of plates extends between a pair of adjacent of extensions of the plurality of extensions to enclose the monolithic core.

In accordance with another embodiment, the present application is directed to a power end core for a power end of a reciprocating pump. The power end core includes a base with a surface and a plurality of ribs offset from one another along an axis, a plurality of extensions integral with the base, and a plurality of apertures formed into the surface of the base for mounting the base to a fluid end of the reciprocating pump. Each extension of the plurality of extensions extends from a respective rib of the plurality of ribs, each extension of the plurality of extensions defines an opening configured to receive a crankshaft of the reciprocating pump, and each aperture of the plurality of apertures is formed through the respective rib of the plurality of ribs.

In accordance with yet another embodiment, the present application is directed to a power end for a reciprocating pump. The power end includes a base with a plurality of ribs offset from one another along an axis, a plurality of extensions integral with the base, and a plurality of frames separate from the base and from the plurality of extensions. Each extension of the plurality of extensions extends from a respective rib of the plurality of ribs such that extensions of the plurality of extensions are offset from one another along the axis, and each extension of the plurality of extensions defines an opening configured to receive a crankshaft of the reciprocating pump. Each frame of the plurality of frames is coupled to the respective rib of the plurality of ribs.

The foregoing advantages and features will become evident in view of the drawings and detailed description.

BRIEF DESCRIPTION OF THE DRAWINGS

To complete the description and in order to provide for a better understanding of the present application, a set of drawings is provided. The drawings form an integral part of the description and illustrate embodiments of the present application, which should not be interpreted as restricting the scope of the disclosure, but just as examples. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the disclosure. Embodiments of the disclosure will be described by way of example, with reference to the above-mentioned drawings showing elements and results according to the present disclosure.

Generally, the present application is directed to a power end of a reciprocating pump. The power end includes a core having a base and extensions that are integral with the base. The base includes ribs that are offset from one another along an axis (e.g., a lateral axis extending from end to end of the power end), and each extension extends from one of the ribs. Bores are formed through the base, and each bore is configured to receive a reciprocating element in an assembled configuration of the reciprocating pump. Apertures are also formed through respective ribs of the base and are used to couple the power end to a fluid end of the reciprocating pump. Openings are formed through the extensions to enable the extensions to receive a crankshaft for driving movement of the reciprocating elements during operation of the reciprocating pump.

The monolithic structure of the base and extensions provides a core with desirable structural integrity, such as by reducing joints or other discontinuities that otherwise can be susceptible to deformation. Moreover, the arrangement of the apertures in the core improves the structural integrity of the power end. In particular, because the apertures are formed through the ribs, the apertures are aligned with the extensions that are integral with the ribs. Thus, a force exerted by the fluid end during operation of the reciprocating pump is transmitted to the power end via the apertures and is distributed along the ribs and to the extensions. As such, the core distributes the force received from the fluid end to reduce concentration of forces that otherwise can deform the core. By increasing the structural integrity of the power end, the arrangement of the core can increase a useful lifespan of the reciprocating pump, such as by reducing a frequency or amount of downtime to perform a maintenance operation for the reciprocating pump.

Figure 1:
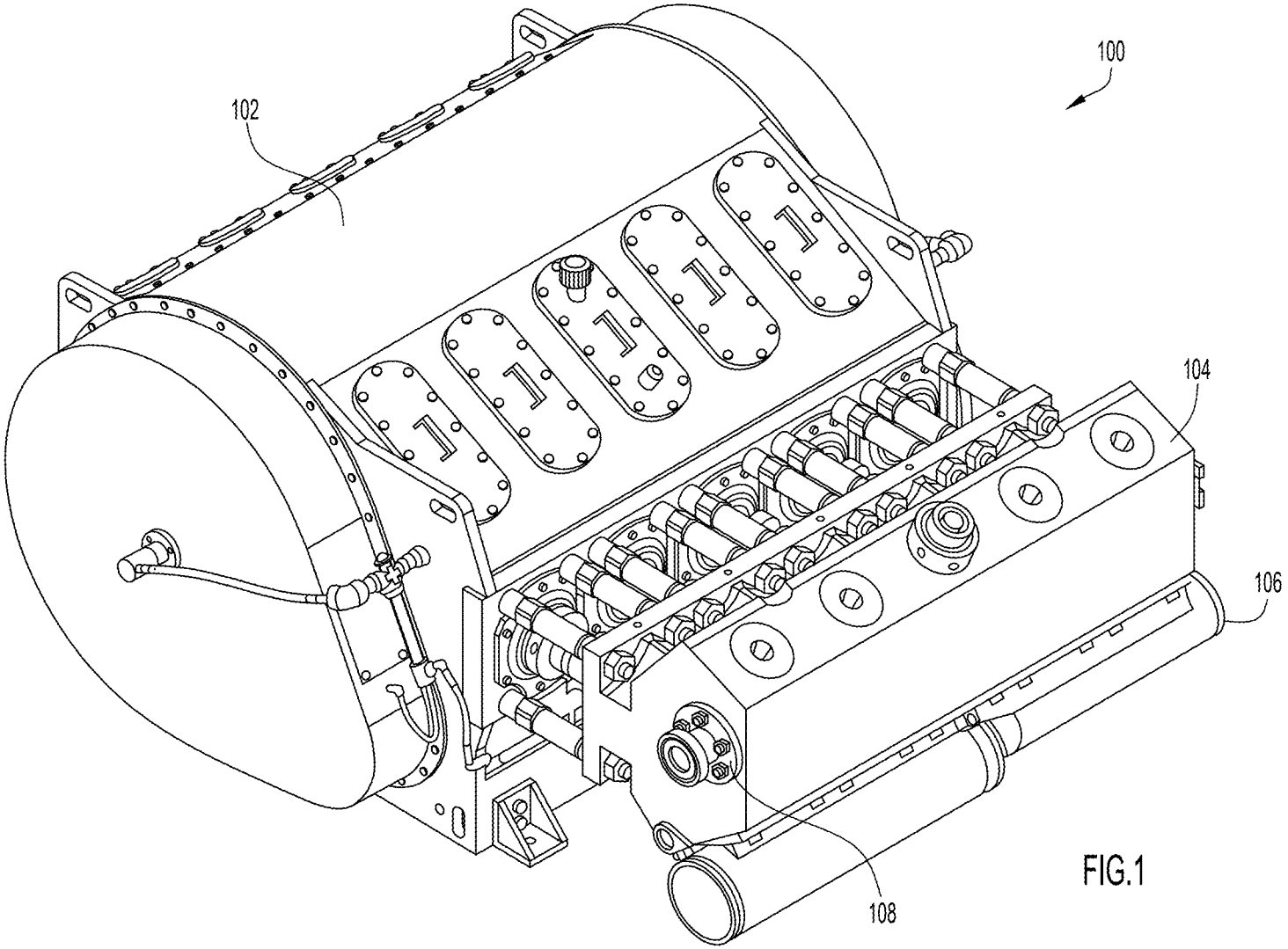
FIG. 1 is a front perspective view of a reciprocating pump including a fluid end and a power end, in accordance with embodiments of the present disclosure.

Referring to FIG. 1, a reciprocating pump 100 is illustrated. The reciprocating pump 100 includes a power end 102 and a fluid end 104. The power end 102 includes a crankshaft that drives a plurality of reciprocating plungers or pistons (generally referred to as "reciprocating elements") enclosed within the fluid end 104 to pump fluid at high pressure (e.g., to cause the fluid end 104 to deliver high pressure fluids to earth drilling operations). For example, the power end 102 may be configured to support hydraulic fracturing (i.e., fracking) operations, where fracking liquid (e.g., a mixture of water, chemicals, and/or sand) is injected into rock formations at high pressures to allow natural oil and gas to be extracted from the rock formations. However, to be clear, this example is not intended to be limiting, and the present application may be applicable to both fracking and drilling operations, as well as any other suitable operations.

In any case, often, the reciprocating pump 100 may be quite large and may, for example, be supported by a semi-tractor truck ("semi") that can move the reciprocating pump 100 to and from a well. Specifically, in some instances, a semi may move the reciprocating pump 100 off a well to perform maintenance on the reciprocating pump 100. However, a reciprocating pump 100 is typically moved off a well only when a replacement pump (and an associated semi) is available to move into place at the well, which may be rare. Thus, often, the reciprocating pump 100 is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, extend the time between maintenance operations (i.e., between downtime), and/or minimize the time to complete maintenance operations (minimizing downtime) are highly desirable.

Figure 2A:
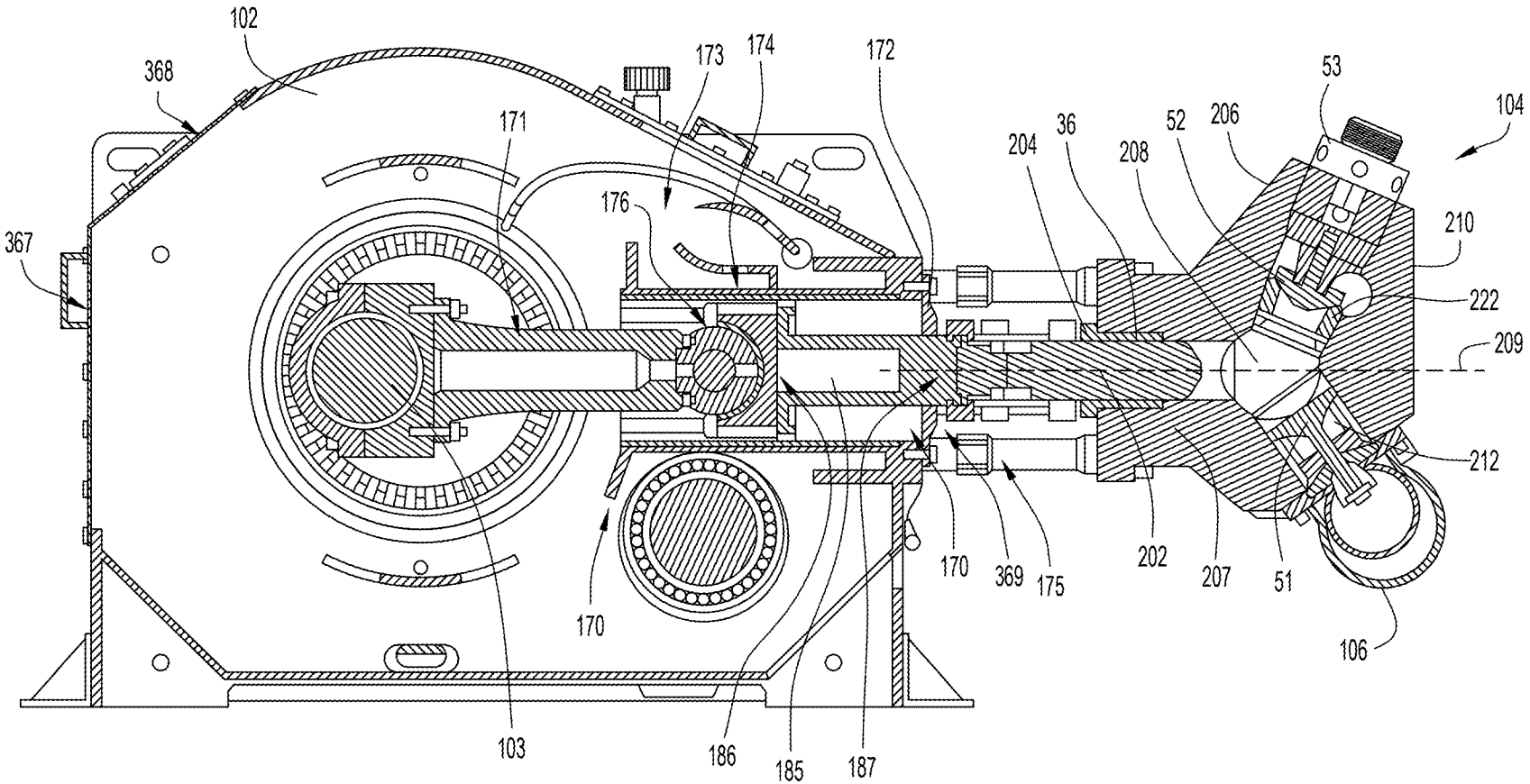
FIG. 2A is a side cross-sectional view of the reciprocating pump of FIG. 1.

Still referring to FIG. 1, but now in combination with FIG. 2A, the reciprocating pump 100 pumps fluid into and out of pumping chambers 208. FIG. 2A shows a side, cross-sectional view of reciprocating pump 100 taken along a central axis 209 of one of the reciprocating elements 202 included in reciprocating pump 100. Thus, FIG. 2A depicts a single pumping chamber 208. However, it should be understood that a fluid end 104 can include multiple pumping chambers 208 arranged side-by-side. In fact, in at least some embodiments (e.g., the embodiment of FIG. 1), a casing 206 of the fluid end 104 forms a plurality of pumping chambers 208, and each pumping chamber 208 includes a reciprocating element 202 that reciprocates within the casing 206. However, side-by-side pumping chambers 208 need not be defined by a single casing 206. For example, in some embodiments, the fluid end 104 may be modular, and different casing segments may house one or more pumping chambers 208. In any case, the one or more pumping chambers 208 are arranged side-by-side so that corresponding conduits are positioned adjacent to each other and generate substantially parallel pumping action. Specifically, with each stroke of the reciprocating element 202, low pressure fluid is drawn into the pumping chamber 208 and high pressure fluid is discharged. During these operations, movement of the crankshaft 103, movement of the reciprocating element 202, and/or flow of fluid, as well as other moving parts, components, and/or flows, may generate stress at the power end 102. The stress can affect a structural integrity of the power end 102. Therefore, maintenance operations (e.g., inspection, replacement, repair) may be performed periodically for the power end 102 to ensure continued operation of the reciprocating pump 100.

In various embodiments, the fluid end 104 may be shaped differently and/or have different features, but may still generally perform the same functions, define similar structures, and house similar components. For example, while the fluid end 104 includes a first bore 204 that intersects an inlet bore 212 and an outlet bore 222 at skewed angles, other fluid ends may include any number of bores arranged along any desired angle or angles, for example, to intersect the first bore 204 (and/or an access bore) substantially orthogonally and/or so that two or more bores are substantially coaxial. Generally, the bores 212 and 222, as well as any other bores (i.e., segments, conduits, etc.), may intersect to form a pumping chamber 208, may be cylindrical or non-cylindrical, and may define openings at an external surface 210 of the casing 206. Additionally, the bores 212 and 222, as well as any other bores (i.e., segments, conduits, etc.), may receive various components or structures, such as sealing assemblies or components thereof.

In the depicted embodiment, the inlet bore 212 defines a fluid path through the fluid end 104 that connects the pumping chamber 208 to a piping system 106 delivering fluid to the fluid end 104. Meanwhile, the outlet bore 222 allows compressed fluid to exit the fluid end 104. Thus, in operation, the bores 212 and 222 may include valve components 51 and 52, respectively, (e.g., one-way valves) that allow the bores 212 and 222 to selectively open and deliver a fluid through the fluid end 104. Typically, the valve components 51 in the inlet bore 212 may be secured therein by a piping system 106 (see FIG. 1). Meanwhile, valve components 52 in outlet bore 222 may be secured therein by a closure assembly 53 that, in the prior art example illustrated in FIG. 2A, is removably coupled to the fluid end 104 via threads.

In operation, fluid may enter the fluid end 104 via outer openings of the inlet bores 212 and exit the fluid end 104 via outer openings of the outlet bores 222. More specifically, fluid may enter inlet bores 212 via pipes of piping system 106, flow through the pumping chamber 208 (due to reciprocation of a reciprocating elements 202), and then through the outlet bores 222 into a channel 108 (see FIG. 1). However, the piping system 106 and the channel 108 are merely example conduits and, in various embodiments, the fluid end 104 may receive and discharge fluid via any number of pipes and/or conduits, along pathways of any desirable size or shape.

Meanwhile, each of the first bores 204 defines, at least in part, a cylinder for reciprocating elements 202 and/or connects the casing 206 to a cylinder for reciprocating elements 202. More specifically, in the illustrated embodiment, a casing segment 207 houses a packing assembly 36 configured to seal against a reciprocating element 202 disposed interiorly of the packing assembly 36. Reciprocation of a reciprocating element 202 in or adjacent to the first bore 204, which may be referred to as a reciprocation bore (or, for fracking applications, a plunger bore), draws fluid into the pumping chamber 208 via the inlet bore 212 and pumps the fluid out of the pumping chamber 208 via the outlet bore 222. To help provide access to these parts and/or the pumping chamber 208, such as for performing maintenance operations, some fluid ends 104 have access bores that are often aligned with (and sometimes coaxial with) the first bore 204. Other fluid ends 104 need not include an access bore and, thus, such an access bore is not illustrated in FIGS. 1 and 2A.

Regardless of whether the fluid end 104 includes an access bore, the packing assembly 36 typically is to be periodically replaced from an outer opening of the first bore 204 (i.e., a side of the first bore 204 aligned with the external surface 210 of the casing 206). At the same time, to operate properly, the fluid end 104 is to be securely and stably coupled to the power end 102. Thus, often, with reciprocating pumps like the reciprocating pump 100, the fluid end 104 is directly coupled to the power end 102 with relatively short couplers 175, and at least a portion of the reciprocating pump 100 is to be disassembled to access the first bore 204, e.g., to replace packing assembly 36.

Figure 2B:
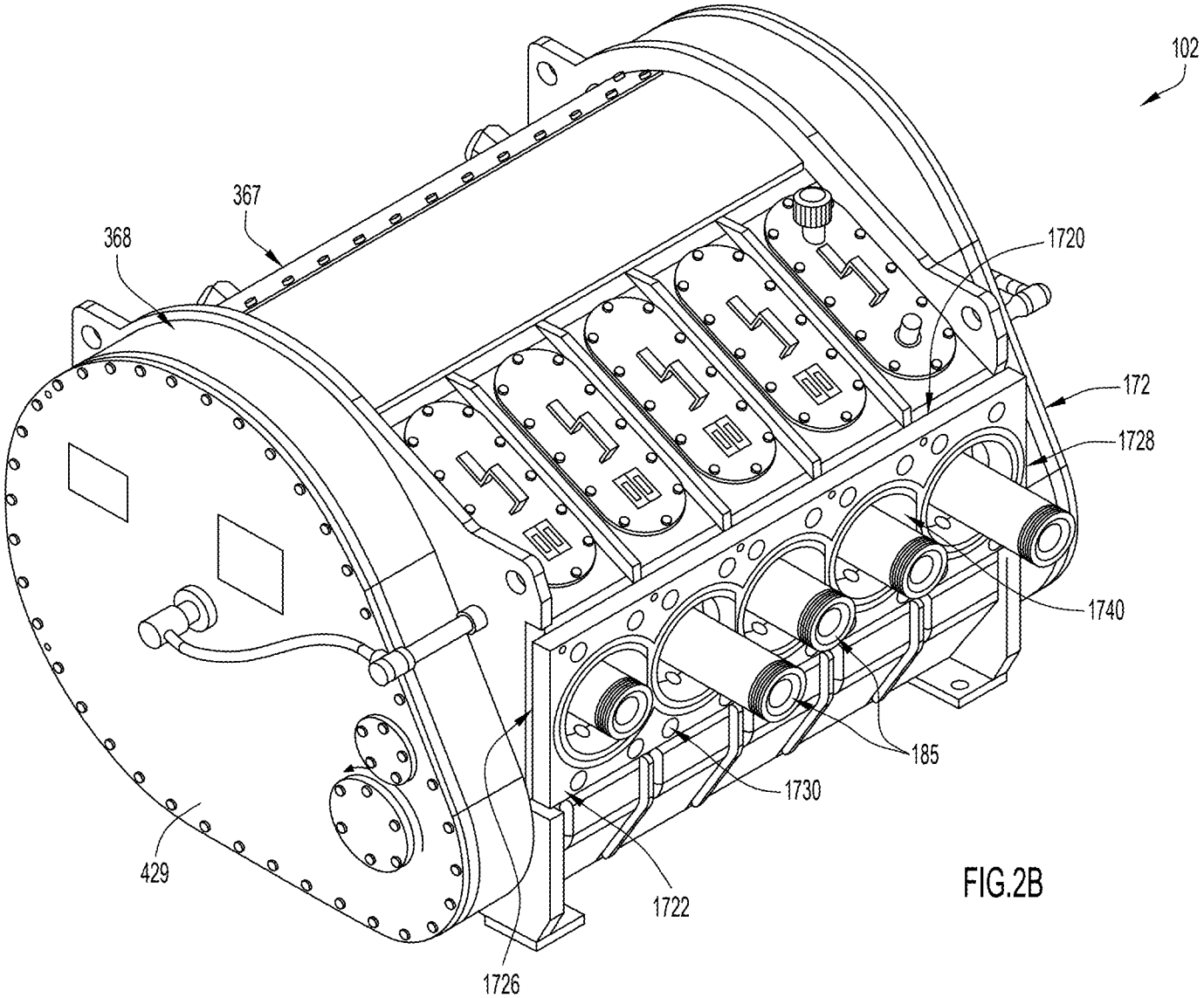
FIG. 2B is a front perspective view of a power end of the reciprocating pump of FIG. 1.

Now turning to FIGS. 2A and 2B, in the depicted reciprocating pump 100, couplers 175 (e.g., tie rods, which are sometimes referred to as stay rods) are threaded to a nose plate 172 of a crosshead assembly 170 of the power end 102 to position the fluid end 104 in close proximity to the power end 102. More specifically, with the power end 102, the locations at which a fluid end 104 may be coupled to the power end 102 are fixed and/or preset by a set of receptacles 1730. In this particular power end 102, the nose plate 172 defines the locations of receptacles 1730 for the power end 102, which is positioned at and/or generally defines a front of the power end 102. However, in other embodiments, the receptacles 1730 could be included in any part or portion of a power end. That is, the power end 102 may include a frame 368 that extends from a front 369 to a back 367, and the receptacles 1730 may generally be included in the front 369 of frame 368. The receptacles 1730 can be seen in FIG. 2B, which shows the power end 102 disconnected from the fluid end 104, e.g., during maintenance of the packing assembly 36 included in the fluid end 104. FIG. 2B also shows how, in this particular embodiment, the nose plate 172 extends from a first end 1726 to a second end 1728 and also extends from a back surface 1720 to a front surface 1722.

In the depicted embodiment, the receptacles 1730 extend into the nose plate 172 from the front surface 1722 and are generally disposed around pony rod holes 1740. However, in other embodiments, the receptacles 1730 need not be positioned as such. In any case, the receptacles 1730 may be threaded so that a threaded coupler 175 can be secured directly therein. Still further, in some instances, the receptacles 1730 need not extend through the back surface 1720, which may prevent the couplers 175 from extending into the crosshead assembly 170 and interfering with operations of the crosshead assembly 170 and/or allowing contaminants into the crosshead assembly 170. However, other embodiments might include receptacles that are through holes.

Still referring to FIGS. 2A and 2B, in the reciprocating pump 100—and in most high pressure reciprocating pumps—a crosshead frame 174 is a part of a crosshead assembly 170 that converts rotational motion of the crankshaft 103 into linear, reciprocating motion of a pony rod 185. More specifically, the crosshead assembly 170 includes a connecting rod 171, a crosshead 173, and a pony rod 185. The crosshead 173 includes a connector 176 disposed within a crosshead frame 174, and the connecting rod 171 extends from the crankshaft 103 to the connector 176. The connector 176 is configured to move linearly within the crosshead frame 174, and opposite ends of the connecting rod 171 are configured to travel with the crankshaft 103 and the connector 176.

Thus, as the connecting rod 171 rotates with the crankshaft 103, the connecting rod 171 reciprocates the connector 176 within the crosshead frame 174. The connector 176 is also connected to a back side 186 of the pony rod 185 so that the pony rod 185 reciprocates with the connector 176. Meanwhile, a front side 187 of the pony rod 185 can be coupled to a reciprocating element 202 (e.g., a plunger), such as via a clamp, to drive reciprocating motion of the reciprocating element 202 that pumps fluid through the fluid end 104. Notably, during this action, the pony rod 185 and/or the crosshead 173 exert forces on the frame 368. These forces stress the frame 368 (and potentially the crosshead frame 174). Such forces may affect a structural integrity of the frame 368. For this reason, forces imparted onto the frame 368 may wear out (e.g., decrease a useful lifespan of) the frame 368 and/or cause downtime of the power end 102, such as to enable performance of a maintenance operation with respect to the frame 368, thereby reducing effective operation of the reciprocating pump 100.

Embodiments of the present disclosure reduce concentration of the forces exerted onto the power end 102. For example, by distributing the forces among different parts of the power end 102 (e.g., along the frame 368), an excessive amount of force that can otherwise deform the power end 102 (e.g., a joint in which the power end 102 is coupled to the nose plate 172) may be avoided. As such, a useful lifespan of the power end 102 and of the reciprocating pump 100 may increase.

Figure 3:
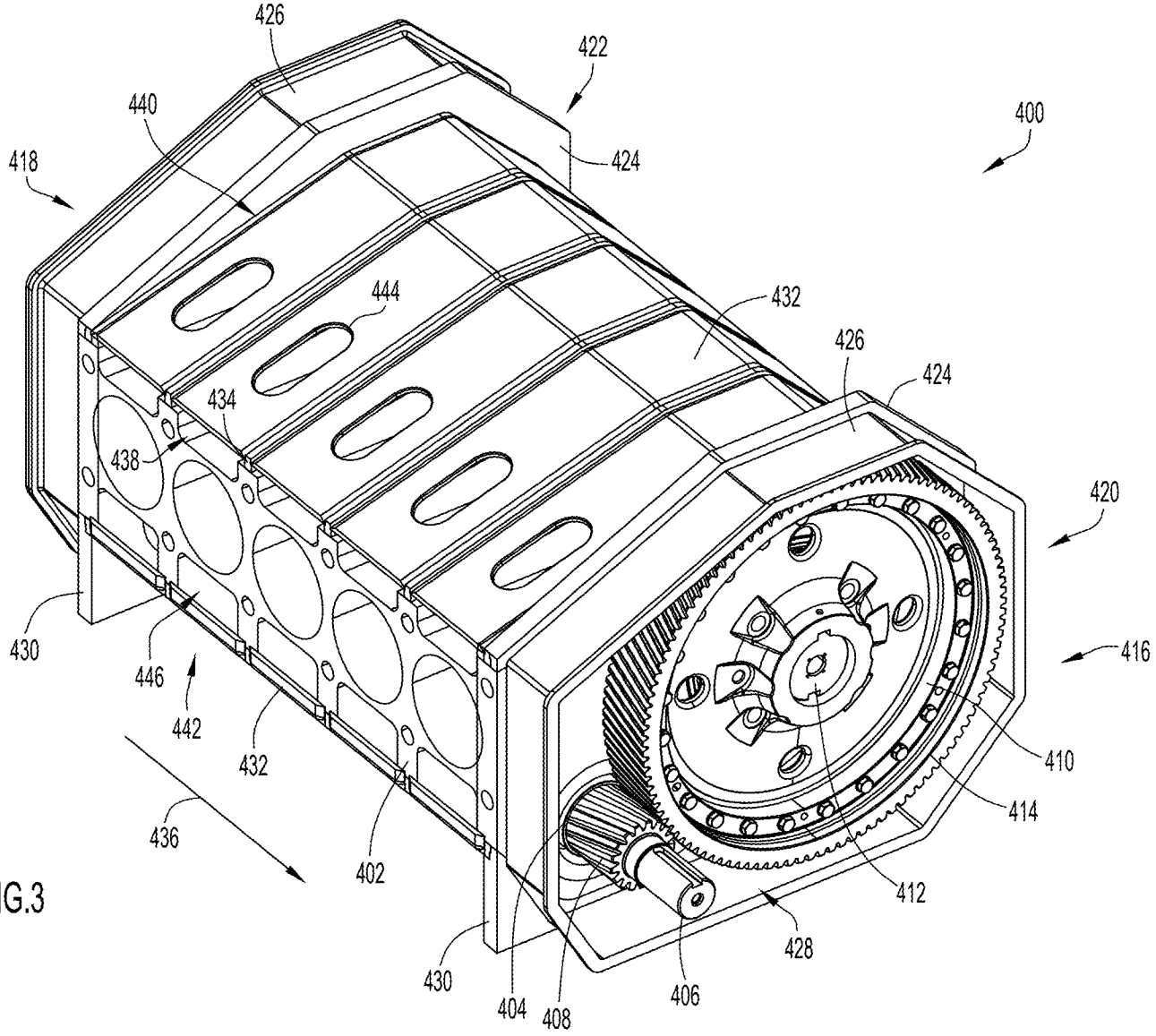
FIG. 3 is a top perspective view of a power end that includes a monolithic core, in accordance with embodiments of the present disclosure.

FIG. 3 is a top perspective view of a power end 400 that includes a core 402. The core 402 is monolithic in that different parts of the core 402 are integral with one another. For example, the core 402 may be extruded, cast, molded, or otherwise formed as one contiguous piece (e.g., through additive manufacturing techniques). The monolithic configuration of the core 402 increases a structural rigidity of the core 402, such as by limiting areas (e.g., joints in which two separate components are coupled to one another) susceptible to deformity in response to a force exerted thereon.

The core 402 is configured to receive one or more pinion bearings 404 and a pinion shaft 406 extending through the pinion bearing(s) 404. A pinion gear 408 is fixed to the pinion shaft 406. The core 402 is also configured to receive one or more crankshaft bearings 410 and a crankshaft 412 extending through the crankshaft bearing(s) 410. A bull gear 414 is fixed to the crankshaft 412 and engages with the pinion gear 408. During operation, the pinion shaft 406 is driven to rotate relative to the core 402 to cause corresponding rotation of the pinion gear 408 fixed to the pinion shaft 406. The engagement between the pinion gear 408 and the bull gear 414 causes the rotation of the pinion gear 408 to drive rotation of the bull gear 414. In turn, rotation of the bull gear 414 drives rotation of the crankshaft 412 to which the bull gear 414 is fixed. Thus, rotation of the pinion shaft 406 drives rotation of the crankshaft 412 via the pinion gear 408 and the bull gear 414. The pinion bearing(s) 404 facilitate rotation of the pinion shaft 406 relative to the core 402, such as by providing an interface having reduced friction to facilitate movement of the pinion shaft 406 relative to the core 402. Similarly, the crankshaft bearing(s) 410 facilitate rotation of the crankshaft 412 relative to the core 402, such as by providing an interface having reduced friction to facilitate movement of the crankshaft 412 relative to the core 402. Thus, the bearings 404, 410 improve efficient operation of the reciprocating pump.

The pinion bearing(s) 404, the pinion shaft 406, the pinion gear 408, the crankshaft bearing(s) 410, the crankshaft 412, and/or the bull gear 414 are positioned at least partially external to the core 402 at a first end 416 (e.g., a first distal end). Additionally or alternatively, another pinion bearing 404, the pinion shaft 406, another pinion gear 408, another crankshaft bearing 410, the crankshaft 412, and/or another bull gear 414 are positioned at least partially external to the core 402 at a second end 418 (e.g., a second distal end), opposite the first end 416. For instance, the pinion shaft 406 and/or the crankshaft 412 may extend through the core 402 from the first end 416 to the second end 418. Still further, in some instances, additional pinion bearings 410 and/or crankshaft bearings 410 may be disposed within the core 402, e.g., to support the pinion shaft 406 and the crankshaft 412 between the first end 416 and the second end 418.

To shield the ends 416, 418 of the core 402, as well as any components disposed exteriorly of the core 402, the power end 400 may include a first cover assembly 420 coupled to the core 402 at the first end 416, as well as a second cover assembly 422 coupled to the core at the second end 418. The cover assemblies 420, 422 enclose the respective ends 416, 418, thereby shielding components at the ends 416, 418 from an external environment. For example, each cover assembly 420, 422 may include a base plate 424 configured to couple to the core 402 and an enclosure 426 defining a space 428 configured to receive and contain the pinion bearing 404, a portion of the pinion shaft 406, the pinion gear 408, the crankshaft bearing 410, a portion of the crankshaft 412, and/or the bull gear 414. In some embodiments, a cap is coupled to the enclosure 426 to cover the space 428 and further shield components disposed within the space 428. To show the aforementioned components, a cap is not depicted in FIG. 3, but FIG. 2B depicts one example cap 429.

Supports 430 (e.g., stands, skids) are also coupled (e.g., welded) to the core 402. The supports 430 help position the power end 400 on a surface, such as by maintaining balance and positioning of the power end 400, as well as supporting a weight of the power end 400. Although the illustrated power end 400 includes supports 430 positioned at the ends 416, 418, it should be noted that in additional or alternative embodiments, the supports 430 may be positioned in any suitable manner along the power end 400, such as at a position between the ends 416, 418 for positioning the power end 400 on a surface (either in addition to or as an alternative to supports at the ends 416 and 418).

In addition, plates 432 extend across an exterior of the core 402 to further enclose and shield the core 402. As an example, frames 434 (e.g., inner frames) may be coupled (e.g., welded) to and surround a portion of the core 402. The frames 434 may be offset from one another along a first axis 436 (e.g., a lateral axis), thereby defining a space 438 between adjacent frames 434 (e.g., a pair of adjacent frames 434). Respective plates 432 are positioned between each space 438 and extend along and are coupled (e.g., welded) to the adjacent frames 434 defining the space 438. The frames 434 are positioned at a first side 440 (e.g., a top side) and at a second side 442 (e.g., a bottom side) of the core 402. In some embodiments, separate plates 432 are coupled to the frames 434 at the first side 440 and at the second side 442. In additional or alternative embodiments, the plates 432 extend from the first side 440 to the second side 442. In other words, a single plate 432 can extend at least partially around the core 402 from the first side 440 to the second side 442 (e.g., around a rear of the core 402). In either case, the plates 432 shield the first side 440 and the second side 442 of the core 402 from an exterior environment.

In the illustrated arrangement of the power end 400, the cover assemblies 420, 422 (e.g., outer frames), the plates 432, and the frames 434 cooperatively define an interior 446 of the power end 400 in which the core 402 is positioned. That is, the core 402 is positioned internal to each of the cover assemblies 420, 422, the plates 432, and the frames 434. Consequently, the cover assemblies 420, 422, the plates 432, and the frames 434 help shield the core 402 from an exterior environment, such as for limiting exposure of the core 402 to dust and debris that otherwise can affect a structural integrity of the core 402. However, in other embodiments, the plates 432 could completely cover the frames 434 to define an exterior of the power end with cover assemblies 420, 422 (and without the frames 434 being exposed to the exterior environment). In such embodiments, edges of the plates 432 are coupled to one another. Indeed, in certain embodiments, the frames 434 are formed as a part of the core 402. In further embodiments, the power end 400 does not include the frames 434 and, instead, the plates 432 are coupled directly to the core 402 and/or to one another to enclose the core 402 within the interior 446.

Moreover, at least some of the plates 432 include an opening 444 that exposes the core 402. By way of example, the opening 444 may provide access to a portion of the core 402, such as for performing a maintenance operation (e.g., inspection, repair, replacement). Thus, even though the core 402 is disposed in the interior 446 of the power end 400, the core 402 may be readily accessible via the plates 432 without having to decouple and remove any of the cover assemblies 420, 422, the plates 432, and/or the frames 434 from the remainder of the power end 400. In certain embodiments, the openings 444 can be covered, such as during operation of the reciprocating pump, using a lid or cover to block exposure of the core 402. Such a lid may be removable to facilitate ease of access to the core 402.

It should also be noted that the separability of the cover assemblies 420, 422, the plates 432, and the frames 434 from one another and from the power end 400 facilitates selectively performing a maintenance operation for a part of the power end 400. As an example, a single frame 434 may be decoupled and removed from the power end 400 to expose a portion of the core 402, thereby enabling a maintenance operation to be performed for the portion of the core 402. However, other frames 434 may remain coupled to and implemented in the power end 400 to cover remaining portions of the core 402. Thus, while a maintenance operation is performed for the portion of the core 402, the remaining portions of the core 402 continue to be shielded to protect the structural integrity of the core 402. As such, an ease of performing the maintenance operation for the core 402 may be improved, such as by reducing a quantity of assembling/disassembling procedures to provide access to the core 402, particularly in comparison to an embodiment of a power end in which all components are integral with or otherwise not readily separable from one another. Moreover, at least a portion of the core 402 may continue to be shielded while a maintenance operation is being performed for the core 402, thereby maintaining a useful lifespan of the core 402.

Further, the separation of the core 402 from the cover assemblies 420, 422, the supports 430, the plates 432, and the frames 434 reduces a complexity in the process used manufacture a monolithic part of the power end 400. By way of example, it may be difficult to provide a monolithic component that includes the intricate geometry provided by the cover assemblies 420, 422, the supports 430, the plates 432, and/or the frames 434 with respect to the core 402, such as the space 438 defined by the frames 434. Thus, manufacture of the power end 400 may be simplified. Further still, increasing the amount of material used for manufacturing an integral component increases the amount of impurities. The impurities can reduce a structural integrity of the integral component. Consequently, limiting a size of the core 402 (e.g., by limiting the selected parts of the power end 400 included therein) can provide a structural integrity to the core 402 that improves a useful lifespan of the power end 400.

Figure 4:
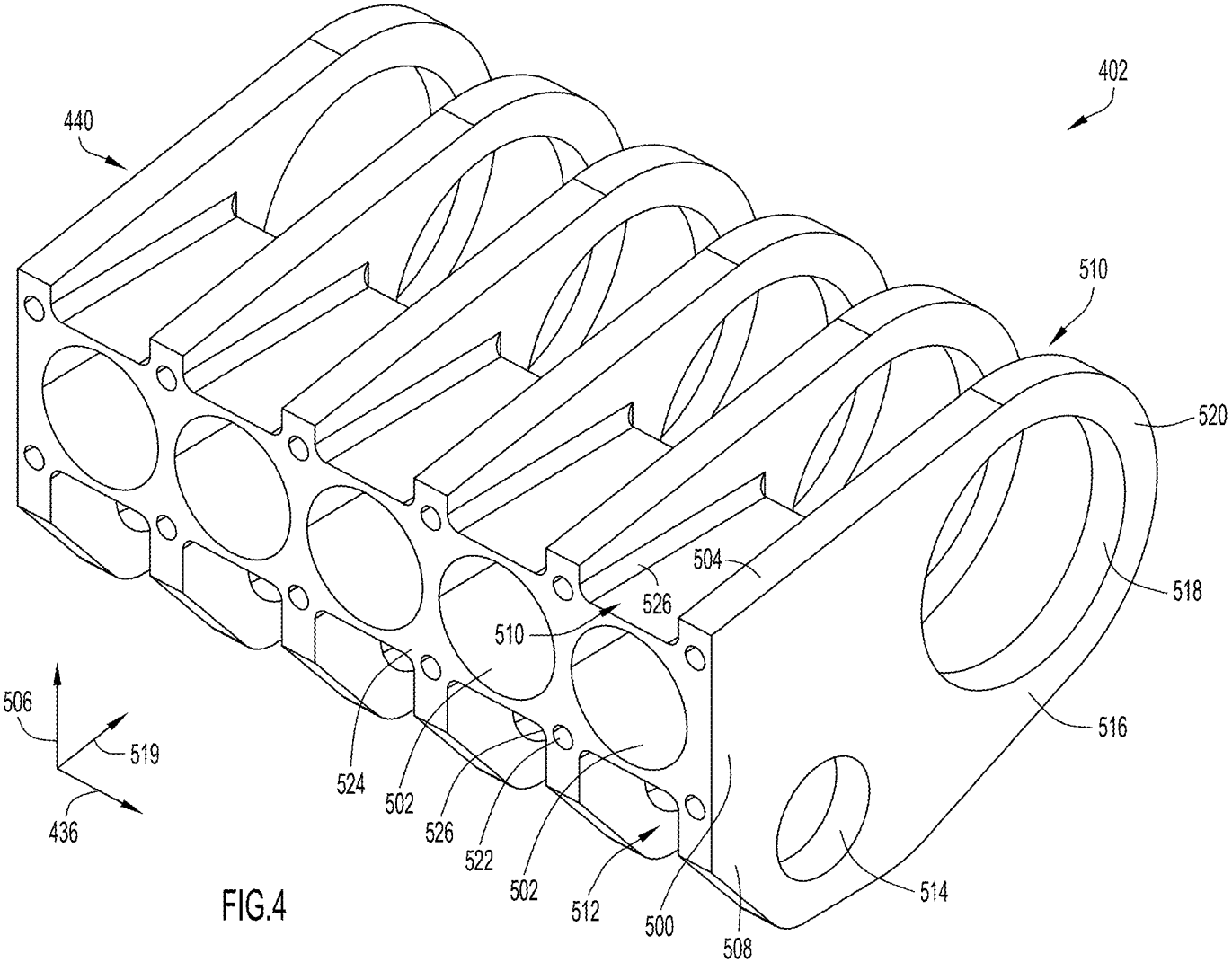
FIG. 4 is a top perspective view of the monolithic core of FIG. 3, in accordance with embodiments of the present disclosure.

FIG. 4 is a top perspective view of the core 402. The core 402 includes a base 500 extending along the first axis 436. Bores 502 are formed through the base 500, and the bores 502 are offset from one another along the first axis 436. Each bore 502 is configured to receive a respective reciprocating element (e.g., pony rod 185) in an assembled configuration of the power end 400. The base 500 also forms first ribs 504 extending along a second axis 506 (e.g., a vertical axis) at the first side 440, as well as second ribs 508 extending along the second axis 506 at the second side 442. The first ribs 504 are separated from one another along the first axis 436 to provide a first gap 510 therebetween, and the second ribs 508 are separated from one another along the first axis 436 to provide a second gap 512 therebetween. As an example, the gaps 510, 512 may provide space for positioning other components of the power end 400 therein (e.g. parts of a lubrication system). In the depicted embodiment, each first rib 504 is aligned with a corresponding second rib 508 along the first axis 436. That is, a first rib 504 and a second rib 508 extend collinearly with one another along the second axis 506. However, other embodiments may include at least some first ribs 504 that are offset from corresponding second ribs 508. In any case, each bore 502 is generally positioned between the offset ribs 504, 508.

First openings 514 are formed through the base 500, such as partially through each second rib 508. Each first opening 514 is configured to receive the pinion shaft 406 and/or a pinion bearing 404. For example, the first openings 514 may be concentric with one another to enable the pinion shaft 406 to extend through the base 500 along the first axis 436. The first openings 514 need not be the same size.

The core 402 further includes extensions 516 that extend from the base 500 along a third axis 519 (e.g., a longitudinal axis). For example, each extension 516 may be integral with one of the first ribs 504 and one of the second ribs 508. Additionally, adjacent extensions 516 are offset from one another such that the first gap 510 extends therebetween. A second opening 518 is formed through each extension 516 to define a ring portion 520 of each extension 516, and each second opening 518 is configured to receive the crankshaft 412 and/or a crankshaft bearing 410. Thus, the crankshaft 412 and/or the crankshaft bearings 410 extend at least partially within the first gaps 510 between the extensions 516. The first gaps 510 ensure that the crankshaft 412 is not inhibited while rotating within the core 402 and/or that the design of the crankshaft 412 is not unduly limited by the space available in the core 402. At the same time, the first gaps 510 limit the amount of material used to form the core 402, providing the cost and fatigue advantages noted above.

The core 402 is also potentially configured to couple to a nose plate (e.g., the nose plate 172) to enable the power end 400 to couple to a fluid end (e.g., the fluid end 104), either via removable connections or fixed connections (e.g., welds). Alternatively, the core 402 may be configured to connect to a fluid end without a nose plate, e.g., via a direct connection or via a removably mount plate. Either way, apertures 522 are formed through a surface 524 of the core 402 (e.g., the same surface 524 through which the bores 502 are formed). Each aperture 522 is configured to receive a coupler (e.g., one of the couplers 175) for coupling the core 402 to the nose plate and/or to the fluid end. In the illustrated embodiment, each aperture 522 extends at least partially into one of the first ribs 504 or one of the second ribs 508. Consequently, each aperture 522 is aligned with an extension 516 along the first axis 436 and is generally offset from the bores 502 along the first axis 436 (e.g., positioned between adjacent bores 502 along the first axis 436).

Such alignment between the apertures 522 and the extension 516 also aligns the couplers with the extension 516 along the first axis 436. This arrangement may help improve the structural integrity of the core 402. As an example, during operation of the reciprocating pump, the couplers coupled to the power end 400 via the apertures 522 of the core 402 transmit forces from the fluid end to the base 500 of the core 402. However, because the apertures 522 are aligned with the first ribs 504 and with the second ribs 508 along the first axis 436, the ribs 504, 508 distribute the forces toward the extensions 516 integral with the ribs 504, 508. Consequently, the forces imparted by the fluid end onto the power end 400 are distributed along different portions of the core 402, thereby limiting concentration of forces at any part of the core 402 and avoiding potential deformation of the core 402, such as at the surface 524 having the apertures 522. Without this transfer and dissipation of forces, the surface 524 may deform when an excessive amount of force is imparted onto a portion (e.g., the base 500) of the core 402. Therefore, the arrangement of the core 402 provides desirable structural rigidity to facilitate operation of the reciprocating pump.

Further still, each of the ribs 504, 508 includes a groove 526. In other words, the ribs 504, 508 curvedly extends at the base 500. The grooves 526 reduce a geometric discontinuity (e.g., a corner) to provide a smoother transition that helps distribute forces. By way of example, the grooves 526 may avoid a concentration of forces and, instead, may distribute forces along the base 500 and/or toward the extensions 516. Thus, the grooves 526 further help avoid an excessive amount of force that could deform a part of the core 402 to increase structural integrity of the core 402.

Figure 5:
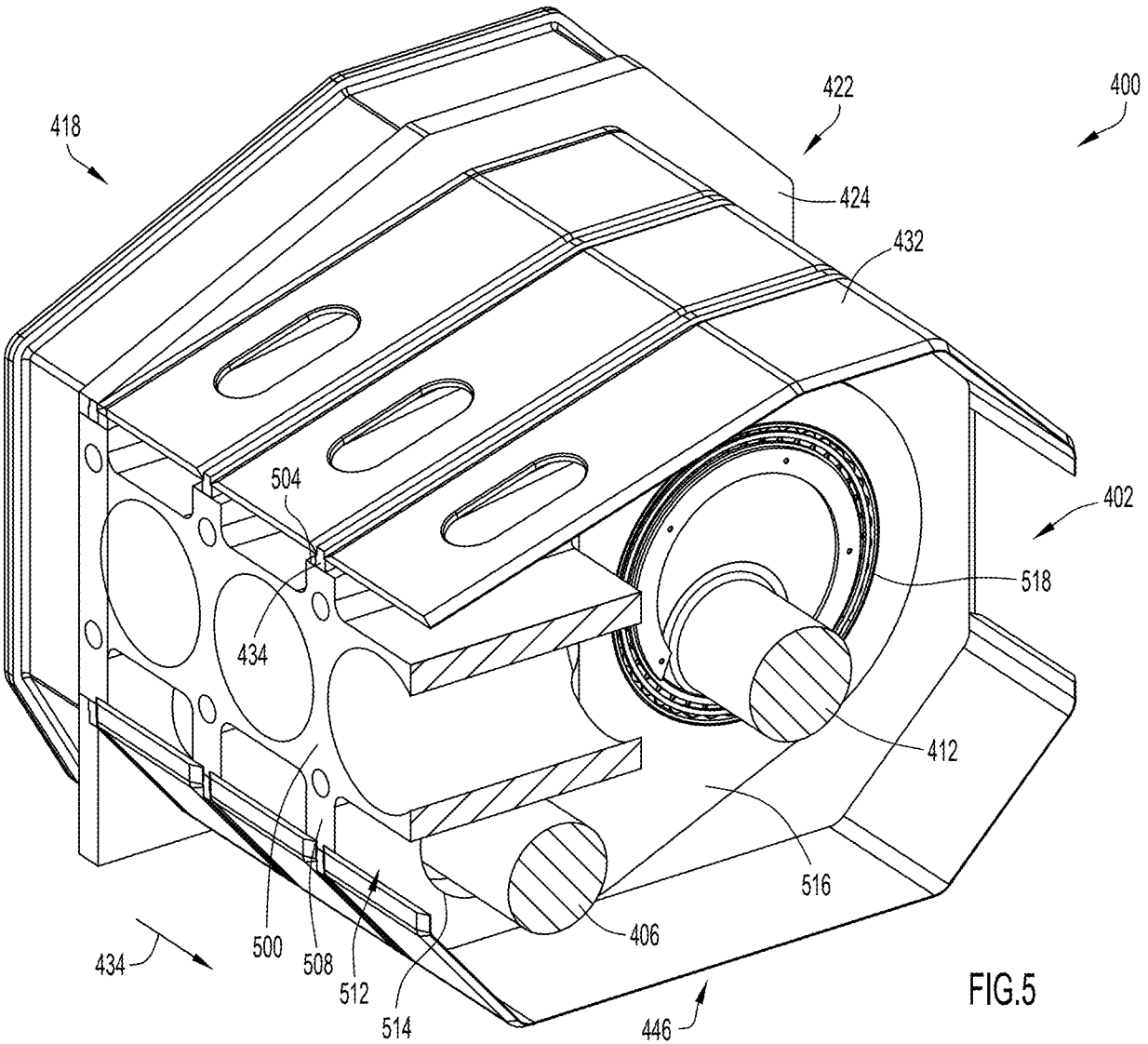
FIG. 5 is a perspective cross-sectional view of the power end of FIG. 3.

FIG. 5 is a perspective cross-sectional view of the core 402 further illustrating a portion of the interior 446. The pinion shaft 406 extends through one of the first openings 514 of the base 500 (e.g., at least partially through the second ribs 508) and into one of the second gaps 512 between the second ribs 508. In certain embodiments, the pinion shaft 406 is positioned concentric to and rotates concentrically about the first openings 514 (e.g., the pinion shaft 406 may be axially aligned with openings 514). The crankshaft 412 extends through one of the second openings 518 and between the extension 516. In some embodiments, the crankshaft 412 is positioned eccentric to and rotates eccentrically within the second openings 518.

FIG. 5 also illustrates how each frame 434 may be aligned with one of the first ribs 504 and one of the second ribs 508, as well as a corresponding one of the extensions 516. As such, each plate 432 extending between a pair of adjacent frames 434 also extends between a pair of adjacent first ribs 504, a pair of adjacent second ribs 508, and a pair of adjacent extensions 516. Meanwhile, the base plate 424 of the second cover assembly 422 is coupled to the base 500 of the core 402 at the second end 418, such as by extending over and/or around the first rib 504, the second rib 508, and the extension 516 positioned at the second end 418 (e.g., the core 402 does not include a frame 434 capturing the first rib 504, the second rib 508, and the extension 516 at the second end 418). For this reason, the plate 432 at the second end 418 is coupled to the base plate 424 and to an adjacent frame 434 instead of, for example, to a pair of adjacent frames 434. However, in additional or alternative embodiments, a frame 434 also extends over and/or around the first rib 504, the second rib 508, and the extension 516 positioned at the second end 418 (e.g., the base plate 424 captures such a frame 434), and the plate 432 at the second end 418 is coupled to such a frame 434 and an adjacent frame 434.

Figure 6:
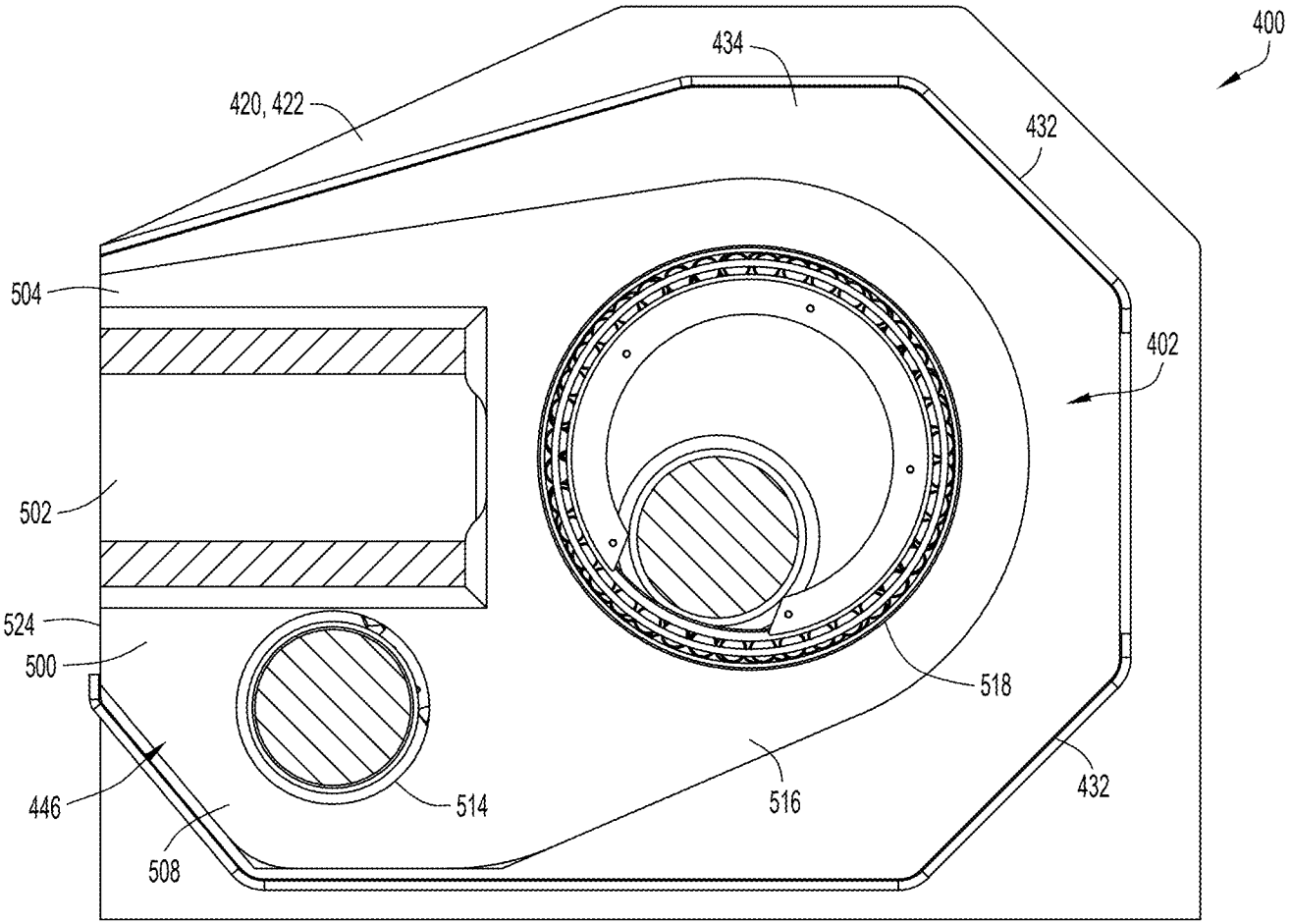
FIG. 6 is a side cross-sectional view of the power end of FIG. 3.

FIG. 6 is a side cross-sectional view of the power end 400. The frame 434 of the illustrated power end 400 surrounds the core 402, such as along the base 500 (e.g., the first rib 504, the second rib 508), as well as along the extension 516. Thus, the frame 434 extends outwardly from the core 402 (e.g., in a distal direction with respect to the interior 446) and up to the surface 524 of the core 402. In other words, the frame 434 is flush with the surface 524. Additionally, the cover assemblies 420, 422 extend outwardly from the frame 434. In some embodiments, each support 430 is coupled to or integral with one of the cover assemblies 420, 422 (e.g., one of the base plates 424) to simplify ease of implementation (e.g., to enable the supports 430 to be installed concurrently with a remainder of the cover assemblies 420, 422). However in additional or alternative embodiments, the supports 430 are separate from the cover assemblies 420, 422 and can be installed at a separate location from the cover assemblies 420, 422, such as to one of the frames 434.

Figure 7:
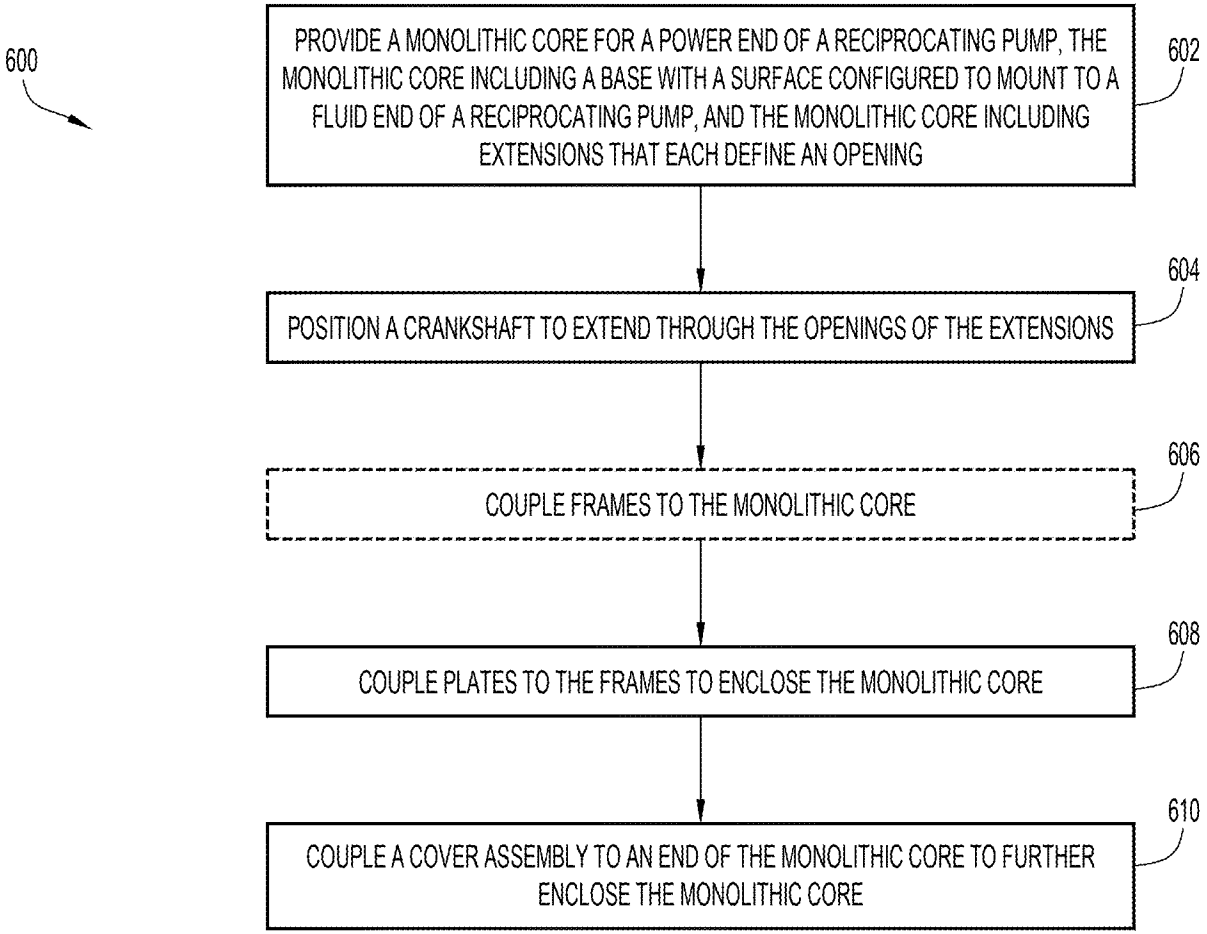
FIG. 7 is a flowchart of a method of manufacture of a power end that includes a monolithic core, in accordance with embodiments of the present disclosure.

FIG. 7 is a flowchart of a method 600 of manufacture of a power end of a reciprocating pump, such as the power end 400. It should be noted that the method 600 may be performed differently in additional or alternative embodiments. For example, an additional operation may be performed, and/or any of the depicted operations of the method 600 may be performed differently, performed in a different order, or not performed.

At block 602, a monolithic core is provided (e.g., manufactured, such as via an extrusion, casting, and/or molding process). The monolithic core includes a base with a surface configured to mount to a fluid end of the reciprocating pump (e.g., using a nose plate). The monolithic core also includes extensions that are integral with the base. For example, the monolithic core may include ribs that are offset from one another along an axis to define a gap therebetween, and the extensions extend from the ribs and are therefore also offset from one another along the axis. Each extension defines an opening, and the openings of the extensions are concentric with one another.

At block 604, a crankshaft is extended through the openings of the extensions (e.g., along the axis). In some embodiments, a crankshaft bearing is positioned into each opening, and the crankshaft is extended through and coupled to each crankshaft bearing. The crankshaft bearings facilitate movement (e.g., rotation) of the crankshaft relative to the monolithic core.

At block 606, frames are coupled to the monolithic core. As an example, each frame is coupled to and captures an extension and ribs that are aligned with one another along the axis. Thus, the frames are also offset from one another along the axis to form a space therebetween. At block 608, plates are disposed within the space between the frames and are coupled to the frames. As such, the plates extend across the space to enclose the monolithic core. By way of example, the plates enclose the crankshaft that extends through the extensions. However, it should be noted that, in some embodiments, the frames are formed as a part of the monolithic core and therefore are not separately coupled to the monolithic core. In further embodiments, the power end does not include frames. In such embodiments, the plates may be coupled to one another instead of to the frames to enclose the monolithic core. Thus, coupling the frames to the monolithic core, as described with respect to block 606, may be an optional operation for certain embodiments of the power end.

At block 610, a cover assembly is coupled to an end of the monolithic core to further enclose the monolithic core. For example, the cover assembly may include a base plate, and the base plate may capture an extension and ribs aligned with one another at the end of the monolithic core. In such embodiments, the plate at the end of the monolithic core is coupled to the base plate. The cover assembly also includes an enclosure coupled to the base plate and defining a space configured to receive various components, such as a gearbox (e.g., a pinion gear, a bull gear) or other linkage that drives movement of the crankshaft relative to the monolithic core. In certain embodiments, the cover assembly further includes a cap configured to cover the space defined by the enclosure to shield the components positioned within the space.

The frames, the plates, and the cover assembly cooperatively enclose the monolithic core, thereby shielding the monolithic core from an exterior environment and increasing a useful lifespan of the monolithic core. However, any of the frames, the plates, or the cover assembly can be decoupled to selectively provide access to a portion of the monolithic core (e.g., while shielding a remainder of the monolithic core). Thus, at least a portion of the monolithic core may remain shielded while access is provided to part of the monolithic core, such as to perform a maintenance operation. In some embodiments, a feature is implemented to facilitate access to a portion of the monolithic core. For example, one of the plates may include an opening that can be uncovered to expose a portion of the monolithic core to the exterior environment and enable observation of the portion of the monolithic core.

The assembled power end may also be coupled to a fluid end of the reciprocating pump. By way of example, apertures may be formed through the ribs of the base of the monolithic core, and couplers may be extended through the apertures to couple the fluid end to base. During operation of the reciprocating pump, the fluid end exerts a force onto the base of the monolithic core via the apertures, and the ribs surrounding the apertures distribute the force along to the extension. Consequently, the force received by the power end from the fluid end is distributed throughout the monolithic core, thereby reducing a concentration of excessive force onto any particular portion of the monolithic core. A structural integrity of the monolithic core and therefore of the power end is thereby improved with such an arrangement of the monolithic core.

While the disclosure has been illustrated and described in detail and with reference to specific embodiments thereof, it is nevertheless not intended to be limited to the details shown, since it will be apparent that various modifications and structural changes may be made therein without departing from the scope and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

Similarly, it is intended that the present disclosure cover the modifications and variations of this disclosure that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present disclosure to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A power end for a reciprocating pump, the power end comprising:

a monolithic core comprising:

a base comprising a surface configured to mount to a fluid end of the reciprocating pump and a plurality of ribs offset from one another along an axis and having a first opening configured to receive a pinion shaft of the reciprocating pump; and a plurality of extensions, wherein each extension of the plurality of extensions extends from a respective rib of the plurality of ribs and is integral to the base, wherein each extension of the plurality of extensions comprises a ring portion that defines a second opening configured to receive a crankshaft of the reciprocating pump; and a plurality of plates separate from the monolithic core, wherein each plate of the plurality of plates extends between a pair of adjacent of extensions of the plurality of extensions to enclose the monolithic core.

2. The power end of claim 1, comprising a plurality of apertures formed into the surface of the base and through the respective rib of the plurality of ribs for mounting the base to the fluid end.

3. The power end of claim 2, comprising a plurality of bores formed through the surface of the base, wherein each bore of the plurality of bores is configured to receive a reciprocating element driven by the crankshaft of the reciprocating pump, and each bore of the plurality of bores is positioned between the pair of adjacent extensions of the plurality of extensions.

4. The power end of claim 2, wherein each first opening of the plurality of ribs is configured to receive a bearing that facilitates movement of the crankshaft.

5. The power end of claim 1, comprising a support separate from the monolithic core and configured to couple to the monolithic core to support a weight of the power end on an additional surface.

6. The power end of claim 5, comprising an end assembly configured to couple to an end of the monolithic core, wherein the end assembly comprises the support.

7. The power end of claim 6, wherein the end assembly is configured to capture an extension of the plurality of extensions at the end of the monolithic core to couple the end assembly to the monolithic core.

8. The power end of claim 1, wherein a plate of the plurality of plates includes a third opening exposing the monolithic core to an exterior environment.

9. A power end core for a power end of a reciprocating pump, the power end core comprising:

a base comprising a surface and a plurality of ribs offset from one another along an axis, wherein each rib of the plurality of ribs comprises a first opening configured to receive a pinion shaft;

a plurality of extensions integral with the base, wherein each extension of the plurality of extensions extends from a respective rib of the plurality of ribs, and each extension of the plurality of extensions defines a second opening configured to receive a crankshaft of the reciprocating pump such that the pinion shaft facilitates movement of the crankshaft; and a plurality of apertures formed into the surface of the base for mounting the base to a fluid end of the reciprocating pump, wherein each aperture of the plurality of apertures is formed through the respective rib of the plurality of ribs.

10. The power end core of claim 9, comprising a plurality of bores formed into the surface of the base, wherein each bore of the plurality of bores is configured to receive a reciprocating element driven by the crankshaft of the reciprocating pump, and each bore of the plurality of bores extends between adjacent ribs of the plurality of ribs.

11. The power end core of claim 9, wherein each rib of the plurality of ribs extends to the surface of the base.

12. The power end core of claim 9, wherein the plurality of ribs extends at a first side of the power end core, and the base comprises an additional plurality of ribs extending at a second side, opposite the first side, of the power end core.

13. The power end core of claim 12, wherein each of the plurality of ribs is aligned with a respective one of the additional plurality of ribs along the axis.

14. The power end core of claim 12, comprising a plurality of additional apertures, wherein each additional aperture of the plurality of additional apertures is formed through a respective one of the additional plurality of ribs.

15. A power end for a reciprocating pump, the power end comprising:

a base comprising a plurality of ribs offset from one another along an axis, wherein each rib of the plurality of ribs includes a first opening configured to receive a pinion shaft;

a plurality of extensions integral with the base, wherein each extension of the plurality of extensions extends from a respective rib of the plurality of ribs such that extensions of the plurality of extensions are offset from one another along the axis, and each extension of the plurality of extensions defines a second opening configured to receive a crankshaft of the reciprocating pump;

a plurality of frames separate from the base and from the plurality of extensions, wherein each frame of the plurality of frames is coupled to the respective rib of the plurality of ribs;

a base plate configured to couple to an end of the base;

an enclosure coupled to the base plate and defining a space configured to receive the crankshaft of the reciprocating pump;

a pinion gear configured to couple to the pinion shaft in the space defined by the enclosure; and a bull gear configured to couple to the crankshaft in the space defined by the enclosure, wherein the bull gear is configured to engage with the pinion gear such that rotation of the pinion gear via rotation of the pinion shaft drives rotation of the bull gear and of the crankshaft.

16. The power end of claim 15, comprising a plurality of plates, where each plate of the plurality of plates is coupled to adjacent frames of the plurality of frames.

17. The power end of claim 15, comprising a plurality of apertures formed through the base, wherein each aperture of the plurality of apertures is configured to receive a coupler for coupling the power end to a fluid end of the reciprocating pump, and each aperture of the plurality of apertures is formed through the respective rib of the plurality of ribs.

18. The power end of claim 15, comprising:

a cap configured to couple to the enclosure to cover the space defined by the enclosure.

19. The power end of claim 15, comprising a plurality of bores formed into the base, wherein each bore of the plurality of bores is configured to receive a reciprocating element driven by the crankshaft of the reciprocating pump, and each bore of the plurality of bores extends between adjacent ribs of the plurality of ribs.

20. The power end of claim 15, wherein each rib of the plurality of ribs extends at a first side of the base, the base comprises a plurality of additional ribs extending at a second side of the base, each rib of the plurality of ribs is aligned with a respective additional rib of the plurality of additional ribs, and each frame of the plurality of frames is coupled to the respective rib of the plurality of ribs, a respective extension of the plurality of extensions, and the respective additional rib of the plurality of additional ribs.

* * * * *